US010455313B2

(12) United States Patent
Boesen

(10) Patent No.: US 10,455,313 B2
(45) Date of Patent: Oct. 22, 2019

(54) WIRELESS EARPIECE WITH FORCE FEEDBACK

(71) Applicant: BRAGI GmbH, München (DE)

(72) Inventor: Peter Vincent Boesen, München (DE)

(73) Assignee: BRAGI GmbH, München (DE)

( * ) Notice: Subject to any disclaimer, the term of this patent is extended or adjusted under 35 U.S.C. 154(b) by 0 days.

(21) Appl. No.: 15/799,417

(22) Filed: Oct. 31, 2017

(65) Prior Publication Data

US 2018/0124495 A1 May 3, 2018

Related U.S. Application Data

(60) Provisional application No. 62/414,999, filed on Oct. 31, 2016.

(51) Int. Cl.
*H04R 1/10* (2006.01)
*H04R 3/04* (2006.01)

(52) U.S. Cl.
CPC ..... *H04R 1/1041* (2013.01); *H04R 3/04* (2013.01); *H04R 1/1016* (2013.01); *H04R 2400/03* (2013.01); *H04R 2420/07* (2013.01); *H04R 2460/01* (2013.01); *H04R 2460/15* (2013.01)

(58) Field of Classification Search
CPC ..... H04R 1/1041; H04R 2400/03; H04R 2420/07; H04R 1/1016; H04R 3/04; H04R 2460/01; H04R 2460/15
USPC ..... 381/74, 58, 107, 376, 380
See application file for complete search history.

(56) References Cited

U.S. PATENT DOCUMENTS

| | | | |
|---|---|---|---|
| 2,325,590 | A | 8/1943 | Carlisle et al. |
| 2,430,229 | A | 11/1947 | Kelsey |
| 3,047,089 | A | 7/1962 | Zwislocki |
| D208,784 | S | 10/1967 | Sanzone |
| 3,586,794 | A | 6/1971 | Michaelis |
| 3,934,100 | A | 1/1976 | Harada |
| 3,983,336 | A | 9/1976 | Malek et al. |
| 4,069,400 | A | 1/1978 | Johanson et al. |
| 4,150,262 | A | 4/1979 | Ono |

(Continued)

FOREIGN PATENT DOCUMENTS

| | | | |
|---|---|---|---|
| CN | 204244472 | U | 4/2015 |
| CN | 104683519 | A | 6/2015 |

(Continued)

OTHER PUBLICATIONS

Akkermans, "Acoustic Ear Recognition for Person Identification", Automatic Identification Advanced Technologies, 2005 pp. 219-223.

(Continued)

*Primary Examiner* — Disler Paul
(74) *Attorney, Agent, or Firm* — Goodhue, Coleman & Owens, P.C.

(57) ABSTRACT

In some embodiments, a method for providing feedback through wireless earpieces, may have one or more of the following steps: (a) detecting a position of the wireless earpieces in ears of a user utilizing a number of contacts, (b) analyzing how to modify communications with the user based on the position, (c) communicating with the user utilizing the analysis, (d) adjusting an orientation of one or more speakers of the wireless earpieces in response to the position, and (e) adjusting a plurality of sensors in response to the position.

5 Claims, 5 Drawing Sheets

(56) References Cited

U.S. PATENT DOCUMENTS 4,334,315 A 6/1982 Ono et al.
D266,271 S 9/1982 Johanson et al.
4,375,016 A 2/1983 Harada
4,588,867 A 5/1986 Konomi
4,617,429 A 10/1986 Bellafiore
4,654,883 A 3/1987 Iwata
4,682,180 A 7/1987 Gans
4,791,673 A 12/1988 Schreiber
4,852,177 A 7/1989 Ambrose
4,865,044 A 9/1989 Wallace et al.
4,984,277 A 1/1991 Bisgaard et al.
5,008,943 A 4/1991 Arndt et al.
5,185,802 A 2/1993 Stanton
5,191,602 A 3/1993 Regen et al.
5,201,007 A 4/1993 Ward et al.
5,201,008 A 4/1993 Arndt et al.
D340,286 S 10/1993 Seo
5,280,524 A 1/1994 Norris
5,295,193 A 3/1994 Ono
5,298,692 A 3/1994 Ikeda et al.
5,343,532 A 8/1994 Shugart
5,347,584 A 9/1994 Narisawa
5,363,444 A 11/1994 Norris
D367,113 S 2/1996 Weeks
5,497,339 A 3/1996 Bernard
5,606,621 A 2/1997 Reiter et al.
5,613,222 A 3/1997 Guenther
5,654,530 A 8/1997 Sauer et al.
5,692,059 A 11/1997 Kruger
5,721,783 A 2/1998 Anderson
5,748,743 A 5/1998 Weeks
5,749,072 A 5/1998 Mazurkiewicz et al.
5,771,438 A 6/1998 Palermo et al.
D397,796 S 9/1998 Yabe et al.
5,802,167 A 9/1998 Hong
D410,008 S 5/1999 Almqvist
5,929,774 A 7/1999 Charlton
5,933,506 A 8/1999 Aoki et al.
5,949,896 A 9/1999 Nageno et al.
5,987,146 A 11/1999 Pluvinage et al.
6,021,207 A 2/2000 Puthuff et al.
6,054,989 A 4/2000 Robertson et al.
6,081,724 A 6/2000 Wilson
6,084,526 A 7/2000 Blotky et al.
6,094,492 A 7/2000 Boesen
6,111,569 A 8/2000 Brusky et al.
6,112,103 A 8/2000 Puthuff
6,157,727 A 12/2000 Rueda
6,167,039 A 12/2000 Karlsson et al.
6,181,801 B1 1/2001 Puthuff et al.
6,208,372 B1 3/2001 Barraclough
6,230,029 B1 5/2001 Yegiazaryan et al.
6,275,789 B1 8/2001 Moser et al.
6,339,754 B1 1/2002 Flanagan et al.
D455,835 S 4/2002 Anderson et al.
6,408,081 B1 6/2002 Boesen
6,424,820 B1 7/2002 Burdick et al.
D464,039 S 10/2002 Boesen
6,470,893 B1 10/2002 Boesen
D468,299 S 1/2003 Boesen
D468,300 S 1/2003 Boesen
6,542,721 B2 4/2003 Boesen
6,560,468 B1 5/2003 Boesen
6,654,721 B2 11/2003 Handelman
6,664,713 B2 12/2003 Boesen
6,690,807 B1 2/2004 Meyer
6,694,180 B1 2/2004 Boesen
6,718,043 B1 4/2004 Boesen
6,738,485 B1 5/2004 Boesen
6,748,095 B1 6/2004 Goss
6,754,358 B1 6/2004 Boesen et al.
6,784,873 B1 8/2004 Boesen et al.
6,823,195 B1 11/2004 Boesen
6,852,084 B1 2/2005 Boesen
6,879,698 B2 4/2005 Boesen
6,892,082 B2 5/2005 Boesen
6,920,229 B2 7/2005 Boesen
6,952,483 B2 10/2005 Boesen et al.
6,987,986 B2 1/2006 Boesen
7,010,137 B1 3/2006 Leedom et al.
7,113,611 B2 9/2006 Leedom et al.
D532,520 S 11/2006 Kampmeier et al.
7,136,282 B1 11/2006 Rebeske
7,203,331 B2 4/2007 Boesen
7,209,569 B2 4/2007 Boesen
7,215,790 B2 5/2007 Boesen et al.
D549,222 S 8/2007 Huang
D554,756 S 11/2007 Sjursen et al.
7,403,629 B1 7/2008 Aceti et al.
D579,006 S 10/2008 Kim et al.
7,463,902 B2 12/2008 Boesen
7,508,411 B2 3/2009 Boesen
D601,134 S 9/2009 Elabidi et al.
7,825,626 B2 11/2010 Kozisek
7,965,855 B1 6/2011 Ham
7,979,035 B2 7/2011 Griffin et al.
7,983,628 B2 7/2011 Boesen
D647,491 S 10/2011 Chen et al.
8,095,188 B2 1/2012 Shi
8,108,143 B1 1/2012 Tester
8,140,357 B1 3/2012 Boesen
D666,581 S 9/2012 Perez
8,300,864 B2 10/2012 Müllenborn et al.
8,406,448 B2 3/2013 Lin
8,436,780 B2 5/2013 Schantz et al.
D687,021 S 7/2013 Yuen
8,719,877 B2 5/2014 VonDoenhoff et al.
8,750,528 B2 * 6/2014 Dong ..... H04R 3/00 381/123
8,774,434 B2 7/2014 Zhao et al.
8,831,266 B1 9/2014 Huang
8,891,800 B1 11/2014 Shaffer
8,994,498 B2 3/2015 Agrafioti et al.
D728,107 S 4/2015 Martin et al.
9,013,145 B2 4/2015 Castillo et al.
9,037,125 B1 5/2015 Kadous
D733,103 S 6/2015 Jeong et al.
9,081,944 B2 7/2015 Camacho et al.
9,237,393 B2 * 1/2016 Abrahamsson ..... H04R 1/1016
9,326,058 B2 * 4/2016 Tachibana ..... H04R 29/001
9,510,159 B1 11/2016 Cuddihy et al.
D773,439 S 12/2016 Walker
D775,158 S 12/2016 Dong et al.
D777,710 S 1/2017 Palmborg et al.
9,544,689 B2 1/2017 Fisher et al.
D788,079 S 5/2017 Son et al.
9,794,653 B2 * 10/2017 Aumer ..... H04Q 9/00
2001/0005197 A1 6/2001 Mishra et al.
2001/0027121 A1 10/2001 Boesen
2001/0043707 A1 11/2001 Leedom
2001/0056350 A1 12/2001 Calderone et al.
2002/0002413 A1 1/2002 Tokue
2002/0007510 A1 1/2002 Mann
2002/0010590 A1 1/2002 Lee
2002/0030637 A1 3/2002 Mann
2002/0046035 A1 4/2002 Kitahara et al.
2002/0057810 A1 5/2002 Boesen
2002/0076073 A1 6/2002 Taenzer et al.
2002/0118852 A1 8/2002 Boesen
2003/0002705 A1 1/2003 Boesen
2003/0065504 A1 4/2003 Kraemer et al.
2003/0100331 A1 5/2003 Dress et al.
2003/0104806 A1 6/2003 Ruef et al.
2003/0115068 A1 6/2003 Boesen
2003/0125096 A1 7/2003 Boesen
2003/0218064 A1 11/2003 Conner et al.
2004/0070564 A1 4/2004 Dawson et al.
2004/0160511 A1 8/2004 Boesen
2005/0017842 A1 1/2005 Dematteo
2005/0043056 A1 2/2005 Boesen
2005/0094839 A1 5/2005 Gwee
2005/0125320 A1 6/2005 Boesen
2005/0148883 A1 7/2005 Boesen
2005/0165663 A1 7/2005 Razumov

(56) References Cited

U.S. PATENT DOCUMENTS

2005/0196009 A1 9/2005 Boesen
2005/0251455 A1 11/2005 Boesen
2005/0266876 A1 12/2005 Boesen
2006/0029246 A1 2/2006 Boesen
2006/0073787 A1 4/2006 Lair et al.
2006/0074671 A1 4/2006 Farmaner et al.
2006/0074808 A1 4/2006 Boesen
2006/0166715 A1 7/2006 Engelen et al.
2006/0166716 A1 7/2006 Seshadri et al.
2006/0220915 A1 10/2006 Bauer
2006/0258412 A1 11/2006 Liu
2008/0076972 A1 3/2008 Dorogusker et al.
2008/0090622 A1 4/2008 Kim et al.
2008/0146890 A1 6/2008 LeBoeuf et al.
2008/0187163 A1 8/2008 Goldstein et al.
2008/0253583 A1 10/2008 Goldstein et al.
2008/0254780 A1 10/2008 Kuhl et al.
2008/0255430 A1 10/2008 Alexandersson et al.
2009/0003620 A1 1/2009 McKillop et al.
2009/0008275 A1 1/2009 Ferrari et al.
2009/0017881 A1 1/2009 Madrigal
2009/0073070 A1 3/2009 Rofougaran ET al.
2009/0097689 A1 4/2009 Prest ET al.
2009/0105548 A1 4/2009 Bart
2009/0154739 A1 6/2009 Zellner
2009/0191920 A1 7/2009 Regen ET al.
2009/0245559 A1 10/2009 Boltyenkov et al.
2009/0261114 A1 10/2009 Mcguire ET al.
2009/0296968 A1 12/2009 Wu et al.
2010/0033313 A1 2/2010 Keady ET al.
2010/0203831 A1 8/2010 Muth ET al.
2010/0210212 A1 8/2010 Sato ET al.
2010/0320961 A1 12/2010 Castillo et al.
2011/0140844 A1 6/2011 McGuire et al.
2011/0216093 A1* 9/2011 Griffin ..... H04R 3/12 345/659
2011/0239497 A1 10/2011 McGuire et al.
2011/0286615 A1 11/2011 Olodort et al.
2012/0057740 A1 3/2012 Rosal
2012/0114132 A1* 5/2012 Abrahamsson ..... H04R 1/1016 381/74
2013/0316642 A1 11/2013 Newham
2013/0346168 A1 12/2013 Zhou et al.
2014/0079257 A1 3/2014 Ruwe et al.
2014/0106677 A1 4/2014 Altman
2014/0122116 A1 5/2014 Smythe
2014/0146976 A1* 5/2014 Rundle ..... H04R 1/1083 381/71.6
2014/0153768 A1 6/2014 Hagen et al.
2014/0163771 A1 6/2014 Demeniuk
2014/0185828 A1 7/2014 Helbling
2014/0219467 A1 8/2014 Kurtz
2014/0222462 A1 8/2014 Shakil et al.
2014/0235169 A1 8/2014 Parkinson et al.
2014/0270227 A1 9/2014 Swanson
2014/0270271 A1 9/2014 Dehe et al.
2014/0335908 A1 11/2014 Krisch et al.
2014/0348367 A1 11/2014 Vavrus et al.
2015/0028996 A1 1/2015 Agrafioti et al.
2015/0035643 A1 2/2015 Kursun
2015/0036835 A1 2/2015 Chen
2015/0110587 A1 4/2015 Hori
2015/0148989 A1 5/2015 Cooper et al.
2015/0245127 A1 8/2015 Shaffer
2015/0264472 A1 9/2015 Aase
2015/0287423 A1* 10/2015 Burke ..... G06F 3/0346 704/275
2015/0356837 A1* 12/2015 Pajestka ..... A61H 3/061 340/4.14
2015/0373467 A1 12/2015 Gelter
2015/0373474 A1 12/2015 Kraft et al.
2016/0033280 A1 2/2016 Moore et al.
2016/0072558 A1 3/2016 Hirsch et al.
2016/0073189 A1 3/2016 Lindén et al.
2016/0094899 A1* 3/2016 Aumer ..... G08B 21/18 340/870.07
2016/0125892 A1 5/2016 Bowen et al.
2016/0353196 A1 12/2016 Baker et al.
2016/0360350 A1 12/2016 Watson et al.
2017/0059152 A1 3/2017 Hirsch et al.
2017/0060262 A1 3/2017 Hviid et al.
2017/0060269 A1 3/2017 Förstner et al.
2017/0061751 A1 3/2017 Loermann et al.
2017/0062913 A1 3/2017 Hirsch et al.
2017/0064426 A1 3/2017 Hviid
2017/0064428 A1 3/2017 Hirsch
2017/0064432 A1 3/2017 Hviid et al.
2017/0064437 A1 3/2017 Hviid et al.
2017/0076361 A1* 3/2017 Levesque ..... G06Q 30/0639
2017/0078780 A1 3/2017 Qian et al.
2017/0078785 A1 3/2017 Qian et al.
2017/0094387 A1* 3/2017 Huwe ..... H04R 1/1016
2017/0094389 A1* 3/2017 Saulsbury ..... H04R 1/1016
2017/0108918 A1 4/2017 Boesen
2017/0109131 A1 4/2017 Boesen
2017/0110124 A1 4/2017 Boesen et al.
2017/0110899 A1 4/2017 Boesen
2017/0111723 A1 4/2017 Boesen
2017/0111725 A1 4/2017 Boesen et al.
2017/0111726 A1 4/2017 Martin et al.
2017/0111740 A1 4/2017 Hviid et al.
2017/0112671 A1* 4/2017 Goldstein ..... A61B 5/6817
2017/0127168 A1 5/2017 Briggs et al.
2017/0142511 A1 5/2017 Dennis
2017/0151447 A1 6/2017 Boesen
2017/0151668 A1 6/2017 Boesen
2017/0151918 A1 6/2017 Boesen
2017/0151930 A1 6/2017 Boesen
2017/0151957 A1 6/2017 Boesen
2017/0151959 A1 6/2017 Boesen
2017/0153114 A1 6/2017 Boesen
2017/0153636 A1 6/2017 Boesen
2017/0154532 A1 6/2017 Boesen
2017/0155985 A1 6/2017 Boesen
2017/0155992 A1 6/2017 Perianu et al.
2017/0155993 A1 6/2017 Boesen
2017/0155997 A1 6/2017 Boesen
2017/0155998 A1 6/2017 Boesen
2017/0156000 A1 6/2017 Boesen
2017/0165147 A1* 6/2017 Ng ..... A61H 3/061
2017/0178631 A1 6/2017 Boesen
2017/0180842 A1 6/2017 Boesen
2017/0180843 A1 6/2017 Perianu et al.
2017/0180897 A1 6/2017 Perianu
2017/0188127 A1 6/2017 Perianu et al.
2017/0188132 A1 6/2017 Hirsch et al.
2017/0193978 A1 7/2017 Goldman
2017/0195795 A1* 7/2017 Mei ..... H04R 5/0335
2017/0195829 A1 7/2017 Belverato et al.
2017/0208393 A1 7/2017 Boesen
2017/0214987 A1 7/2017 Boesen
2017/0215016 A1 7/2017 Dohmen et al.
2017/0230752 A1 8/2017 Dohmen et al.
2017/0251933 A1 9/2017 Braun et al.
2017/0257698 A1 9/2017 Boesen et al.
2017/0263236 A1 9/2017 Boesen et al.
2017/0273622 A1 9/2017 Boesen
2017/0374448 A1* 12/2017 Patel ..... H04R 1/1041
2018/0295462 A1* 10/2018 Di Censo ..... H04R 1/345

FOREIGN PATENT DOCUMENTS

CN 104837094 A 8/2015
EP 1469659 A1 10/2004
EP 1017252 A3 5/2006
EP 2903186 A1 8/2015
GB 2074817 4/1981
GB 2508226 A 5/2014
WO 2008103925 A1 8/2008
WO 2007034371 A3 11/2008
WO 2011001433 A2 1/2011
WO 2012071127 A1 5/2012
WO 2013134956 A1 9/2013

(56) References Cited

FOREIGN PATENT DOCUMENTS

| | | | |
|---|---|---|---|
| WO | 2014046602 | A1 | 3/2014 |
| WO | 2014043179 | A3 | 7/2014 |
| WO | 2015061633 | A2 | 4/2015 |
| WO | 2015110577 | A1 | 7/2015 |
| WO | 2015110587 | A1 | 7/2015 |
| WO | 2016032990 | A1 | 3/2016 |

OTHER PUBLICATIONS

Announcing the $3,333,333 Stretch Goal (Feb. 24, 2014).
Ben Coxworth: "Graphene-based ink could enable low-cost, foldable electronics", "Journal of Physical Chemistry Letters", Northwestern University, (May 22, 2013).
Blain: "World's first graphene speaker already superior to Sennheiser MX400", htt://www.gizmag.com/graphene-speaker-beats-sennheiser-mx400/31660, (Apr. 15, 2014).
BMW, "BMW introduces BMW Connected—The personalized digital assistant", "http://bmwblog.com/2016/01/05/bmw-introduces-bmw-connected-the-personalized-digital-assistant", (Jan. 5, 2016).
BRAGI Is On Facebook (2014).
BRAGI Update—Arrival Of Prototype Chassis Parts—More People—Awesomeness (May 13, 2014).
BRAGI Update—Chinese New Year, Design Verification, Charging Case, More People, Timeline(Mar. 6, 2015).
BRAGI Update—First Sleeves From Prototype Tool—Software Development Kit (Jun. 5, 2014).
BRAGI Update—Let's Get Ready To Rumble, A Lot To Be Done Over Christmas (Dec. 22, 2014).
BRAGI Update—Memories From April—Update On Progress (Sep. 16, 2014).
BRAGI Update—Memories from May—Update On Progress—Sweet (Oct. 13, 2014).
BRAGI Update—Memories From One Month Before Kickstarter—Update On Progress (Jul. 10, 2014).
BRAGI Update—Memories From The First Month of Kickstarter—Update on Progress (Aug. 1, 2014).
BRAGI Update—Memories From The Second Month of Kickstarter—Update On Progress (Aug. 22, 2014).
BRAGI Update—New People ©BRAGI—Prototypes (Jun. 26, 2014).
BRAGI Update—Office Tour, Tour To China, Tour to CES (Dec. 11, 2014).
BRAGI Update—Status On Wireless, Bits and Pieces, Testing—Oh Yeah, Timeline(Apr. 24, 2015).
BRAGI Update—The App Preview, The Charger, The SDK, BRAGI Funding and Chinese New Year (Feb. 11, 2015).
BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update—Alpha 5 and Back To China, Backer Day, On Track(May 16, 2015).
BRAGI Update—Beta2 Production and Factory Line(Aug. 20, 2015).
BRAGI Update—Certifications, Production, Ramping Up.
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2015).
BRAGI Update—On Track, Design Verification, How It Works and What's Next(Jul. 15, 2015).
BRAGI Update—On Track, On Track and Gems Overview.
BRAGI Update—Status On Wireless, Supply, Timeline and Open House@BRAGI(Apr. 1, 2015).
BRAGI Update—Unpacking Video, Reviews On Audio Perform and Boy Are We Getting Close(Sep. 10, 2015).
Healthcare Risk Management Review, "Nuance updates computer-assisted physician documentation solution" (Oct. 20, 2016).
Hoffman, "How to Use Android Beam to Wirelessly Transfer Content Between Devices", (Feb. 22, 2013).
Hoyt et. al., "Lessons Learned from Implementation of Voice Recognition for Documentation in the Military Electronic Health Record System", The American Health Information Management Association (2017).
Hyundai Motor America, "Hyundai Motor Company Introduces A Health + Mobility Concept For Wellness In Mobility", Fountain Valley, Californa (2017).
International Search Report & Written Opinion, PCT/EP2016/070231 (dated Nov. 18, 2016).
Last Push Before The Kickstarter Campaign Ends on Monday 4pm CET (Mar. 28, 2014).
Nigel Whitfield: "Fake tape detectors, 'from the stands' footie and UGH? Internet of Things in my set-top box"; http://www.theregister.co.uk/2014/09/24/ibc_round_up_object_audio_dina_iot/ (Sep. 24, 2014).
Nuance, "ING Netherlands Launches Voice Biometrics Payment System in the Mobile Banking App Powered by Nuance", "https://www.nuance.com/about-us/newsroom/press-releases/ing-netherlands-launches-nuance-voice-biometrics.html", 4 pages. (Jul. 28, 2015).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for The Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From BRAGI—$3,000,000—Yipee (Mar. 22, 2014).
Wertzner et al., "Analysis of fundamental frequency, jitter, shimmer and vocal intensity in children with phonological disorders", V. 71, n.5, 582-588, Sep./Oct. 2005; Brazilian Journal of Othrhinolaryngology.
Wikipedia, "Gamebook", https://en.wikipedia.org/wiki/Gamebook, Sep. 3, 2017, 5 pages.
Nikipedia, "Kinect", "https://en.wikipedia.org/wiki/Kinect", 18 pages, (Sep. 9, 2017).
Wikipedia, "Wii Balance Board", "https://en.wikipedia.org/wiki/Wii_Balance_Board", 3 pages, (Jul. 20, 2017).

* cited by examiner

WIRELESS EARPIECE WITH FORCE FEEDBACK

PRIORITY STATEMENT

This application claims priority to U.S. Provisional Patent Application No. 62/414,999 titled Wireless Earpiece with Force Feedback filed on Oct. 31, 2016 all of which hereby incorporated by reference in its entirety.

FIELD OF THE INVENTION

The illustrative embodiments relate to portable electronic devices. Specifically, embodiments of the present invention relate to wireless earpieces. More specifically, but not exclusively, the illustrative embodiments relate to a system, method and wireless earpieces for providing force feedback to a user.

BACKGROUND

The growth of wearable devices is increasing exponentially. This growth is fostered by the decreasing size of microprocessors, circuitry boards, chips and other components. In some cases, wearable devices may include earpieces worn in the ears. Headsets are commonly used with many portable electronic devices such as portable music players and mobile phones. Headsets can include non-cable components such as a jack, headphones and/or a microphone and one or more cables interconnecting the non-cable components. Other headsets can be wireless. The headphones—the component generating sound—can exist in many different form factors, such as over-the-ear headphones or as in-the-ear or in-the-canal earbuds.

The positioning of an earpiece at the external auditory canal of a user brings with it many benefits. For example, the user is able to perceive sound directed from a speaker toward the tympanic membrane allowing for a richer auditory experience. This audio may be the speech, music or other types of sounds. Alerting the user of different information, data and warnings may be complicated while generating high quality sound in the earpiece. In addition, many earpieces rely on utilization of all of the available space of the external auditory canal luminal area in order to allow for stable placement and position maintenance providing little room for interfacing components.

SUMMARY

Therefore, it is a primary object, feature, or advantage of the present invention to improve over the state of the art.

In some embodiments, a method for providing feedback through wireless earpieces, may have one or more of the following steps: (a) detecting a position of the wireless earpieces in ears of a user utilizing a number of contacts, (b) analyzing how to modify communications with the user based on the position, (c) communicating with the user utilizing the analysis, (d) adjusting an orientation of one or more speakers of the wireless earpieces in response to the position, and (e) adjusting a plurality of sensors in response to the position.

In some embodiments, a wireless earpiece, may have one or more of the following features: (a) a housing for fitting in an ear of a user, (b) a processor controlling functionality of the wireless earpiece, (c) a plurality of contacts detecting a position of the wireless earpiece within an ear of the user, wherein the processor analyzes how to modify communications with the user based on the position, and communicate with the user utilizing the analysis, and (d) one or more speakers wherein orientation or performance of the one or more speakers are adjusted in response to the position.

In some embodiments, wireless earpieces may have one or more of the following features: (a) a processor for executing a set of instructions, and (b) a memory for storing the set of instructions, wherein the set of instructions are executed to: (i) detect a position of the wireless earpieces in ears of a user utilizing a number of contacts, (ii) analyze how to modify communications with the user based on the position, (iii) provide feedback to the user utilizing the analysis, (iv) adjusting and orientation of one or more speakers of the wireless earpieces in response to the position.

One or more of these and/or other objects, features, or advantages of the present invention will become apparent from the specification and claims follow. No single embodiment need provide each and every object, feature, or advantage. Different embodiments may have different objects, features, or advantages. Therefore, the present invention is not to be limited to or by an objects, features, or advantages stated herein.

BRIEF DESCRIPTION OF THE DRAWINGS

Illustrated embodiments of the disclosure are described in detail below with reference to the attached drawing figures, which are incorporated by reference herein.

DETAILED DESCRIPTION

Figure 1:
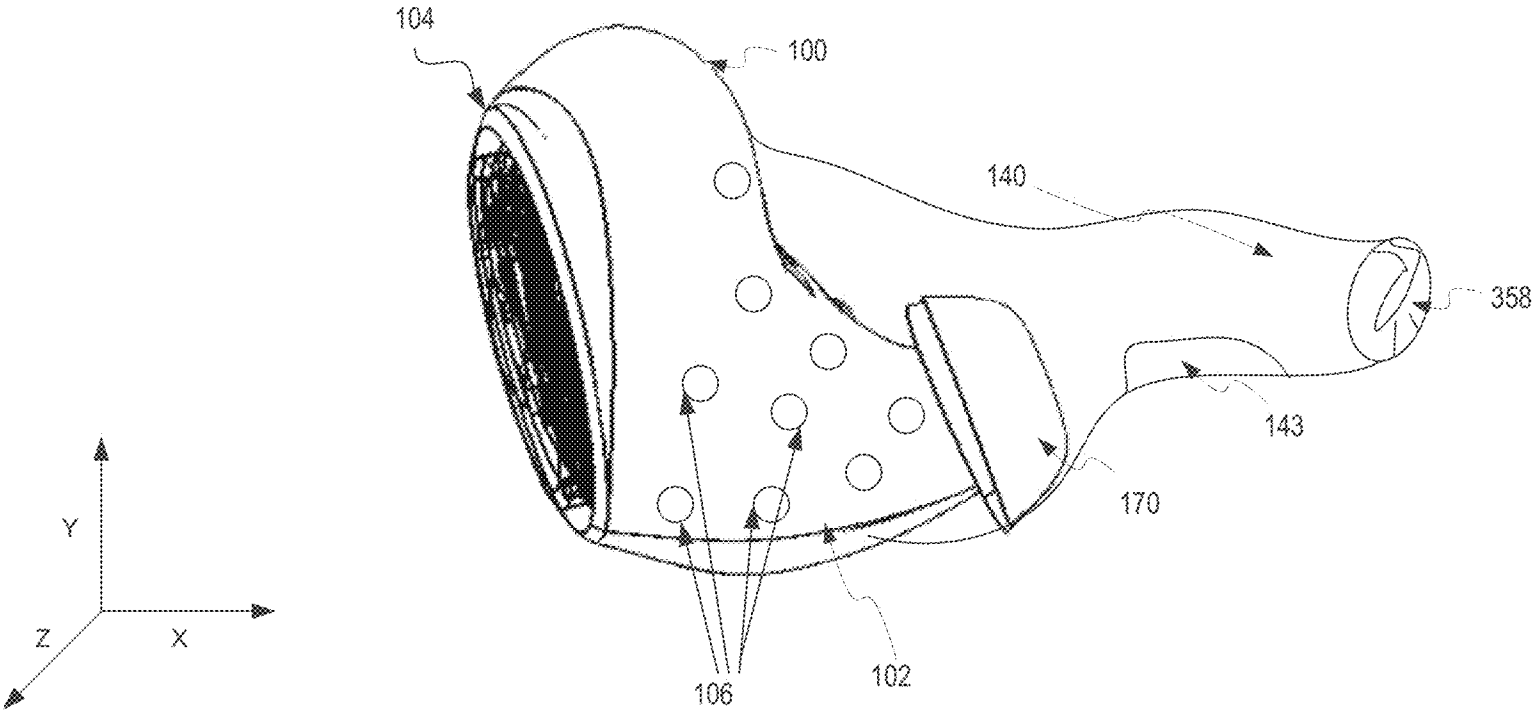
FIG. 1 is a pictorial representation of a wireless earpiece inserted in an ear of a user in accordance with an illustrative embodiment.

The following discussion is presented to enable a person skilled in the art to make and use the present teachings. Various modifications to the illustrated embodiments will be readily apparent to those skilled in the art and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings. While embodiments of the present invention are discussed in terms of wearable device feedback and positioning, it is fully contemplated embodiments of the present invention could be used in most any electronic communications device without departing from the spirit of the invention.

The illustrative embodiments provide a system, method, and wireless earpieces providing force feedback to a user. It is understood the term feedback is used to represent some form of electrical, mechanical or chemical response of the wireless earpieces during use which allows the wireless earpieces to make real-time changes either with or without the user's assistance to modify the user's listening experience. In one embodiment, the wireless earpieces may include any number of sensors and contacts for providing the feedback. In another embodiment, the sensors or contacts may determine the fit of the wireless earpieces within the ears of the user. The fit of the wireless earpieces may be utilized to provide custom communications or feedback to the user. For example, the contacts may determine how the wireless earpieces fit into each ear of the user to adapt the associated feedback. The feedback may be provided through the contacts and sensors as well as the speakers of the wireless earpieces. The information regarding the fit of the wireless earpieces may be utilized to configure other systems of the wireless earpieces for modifying performance. For purposes of embodiments of the present invention, modifying performance can include any and all modifications and altering of performance to enhance a user's audio experience.

FIG. 1 is a pictorial representation of a wireless earpiece 100 in accordance with an illustrative embodiment. The wireless earpiece 100 is representative of one or both of a matched pair of wireless earpieces, such as a right and left wireless earpiece. The wireless earpiece 100 may have any number of components and structures. In one embodiment, the portion of the wireless earpiece 100 fitting into a user's ear and contacting the various surfaces of the user's ear is referred to as a contact surface 102. The contact surface 102 may be a cover or exterior surface of the wireless earpiece 100. In one embodiment, the contact surface 102 may include any number of contacts 106, electrodes, ports or interfaces. In another embodiment, the contact surface 102 may be formed in part of a lightweight silicone cover fitting over a housing 104 of the wireless earpiece 100. The cover may cover the contacts 106 while still enabling their operation or may include cut-outs or openings corresponding to the wireless earpiece 100. The contact surface 102 is configured to fit against the user's ear to communicate audio content through one or more speakers 170 of the wireless earpiece 100.

In one embodiment, the contact surface 102 may represent all or a portion of the exterior surface of the wireless earpiece 100. The contact surface 102 may include a number of contacts 106 evenly or randomly positioned on the exterior of the wireless earpiece 100. The contacts 106 of the contact surface 102 may represent electrodes, ports or interfaces of the wireless earpiece 100. In one embodiment, the contact surface 102 may be utilized to determine how the wireless earpiece 100 fits within the ear of the user. As is well known, the shape and size of each user's ear varies significantly. The contact surface 102 may be utilized to determine the user's ear shape and fit of the wireless earpiece 100 within the ear of the user. The processor 310 (FIG. 2) or processor 401 (FIG. 4) of the wireless earpiece 100 or computing system 400 (FIG. 4) may then utilize the measurements or readings from the contacts 106 to configure how feedback is provided to the user (e.g., audio, tactile, electrical impulses, error output, etc.).

The contacts 106 may be created utilizing any number of semi-conductor or miniaturized manufacturing processes (e.g., liquid phase exfoliation, chemical vapor/thin film deposition, electrochemical synthesis, hydrothermal self-assembly, chemical reduction, micromechanical exfoliation, epitaxial growth, carbon nanotube deposition, nano-scale 3D printing, spin coating, supersonic spray, carbon nanotube unzipping, etc.). For example, materials, such as graphene, nanotubes, transparent conducting oxides, transparent conducting polymers, or so forth. The contacts 106 may be utilized to detect contact with the user or proximity to the user. For example, the contacts 106 may detect physical contact with skin or tissue of the user based on changes in conductivity, capacitance or the flow of electrons. In another example, the contacts 106 may be optical sensors (e.g., infrared, ultraviolet, visible light, etc.) detecting the proximity of each contact to the user. The information from the contacts 106 may be utilized to determine the fit of the wireless earpiece 100.

The housing 104 of the wireless earpiece 100 may be formed from plastics, polymers, metals, or any combination thereof. The contacts 106 may be evenly distributed on the surface 102 to determine the position of the wireless earpiece 100 in the user's ear. In one embodiment, the contacts 106 may be formed through a deposition process. In another embodiment, the contacts 106 may be layered, shaped and then secured utilizing other components, such as adhesives, tabs, clips, metallic bands, frameworks or other structural components. In one embodiment, layers of materials (e.g., the contacts 106) may be imparted, integrated, or embedded on a substrate or scaffolding (such as a base portion of the housing 104) may remain or be removed to form one or more contacts 106 of the wireless earpiece 100 and the entire contact surface 102. In one example, the contacts 106 may be reinforced utilizing carbon nanotubes. The carbon nanotubes may act as reinforcing bars (e.g., an aerogel, graphene oxide hydrogels, etc.) strengthening the thermal, electrical, and mechanical properties of the contacts 106.

In one embodiment, during the manufacturing process one or more layers of the contacts 106 may be deposited on a substrate to form a desired shape and then soaked in solvent. The solvent may be evaporated over time leaving the contacts 106 in the shape of the underlying structure. For example, the contacts 106 may be overlaid on the housing 104 to form all or portions of the support structure and/or electrical components of the wireless earpiece 100. The contacts 106 may represent entire structures, layers, meshes, lattices, or other configurations.

The contact surface 102 may include one or more sensors and electronics, such as contacts 106, optical sensors, accelerometers 336 (FIG. 5), temperature sensors, gyroscopes 332 (FIG. 5), speakers 170 (FIG. 5), microphones 338 (FIG. 5) or so forth. The additional components may be integrated with the various layers or structure of the contact surface 102. The contacts 106 may utilize any number of shapes or configurations. In one embodiment, the contacts 106 are substantially circular shaped. In another embodiment, the contacts 106 may be rectangles or ellipses. In another embodiment, the contacts 106 may represent lines of contacts or sensors. In another embodiment, the contacts 106 may represent a grid or other pattern of contacts, wires, or sensors.

Figure 5:
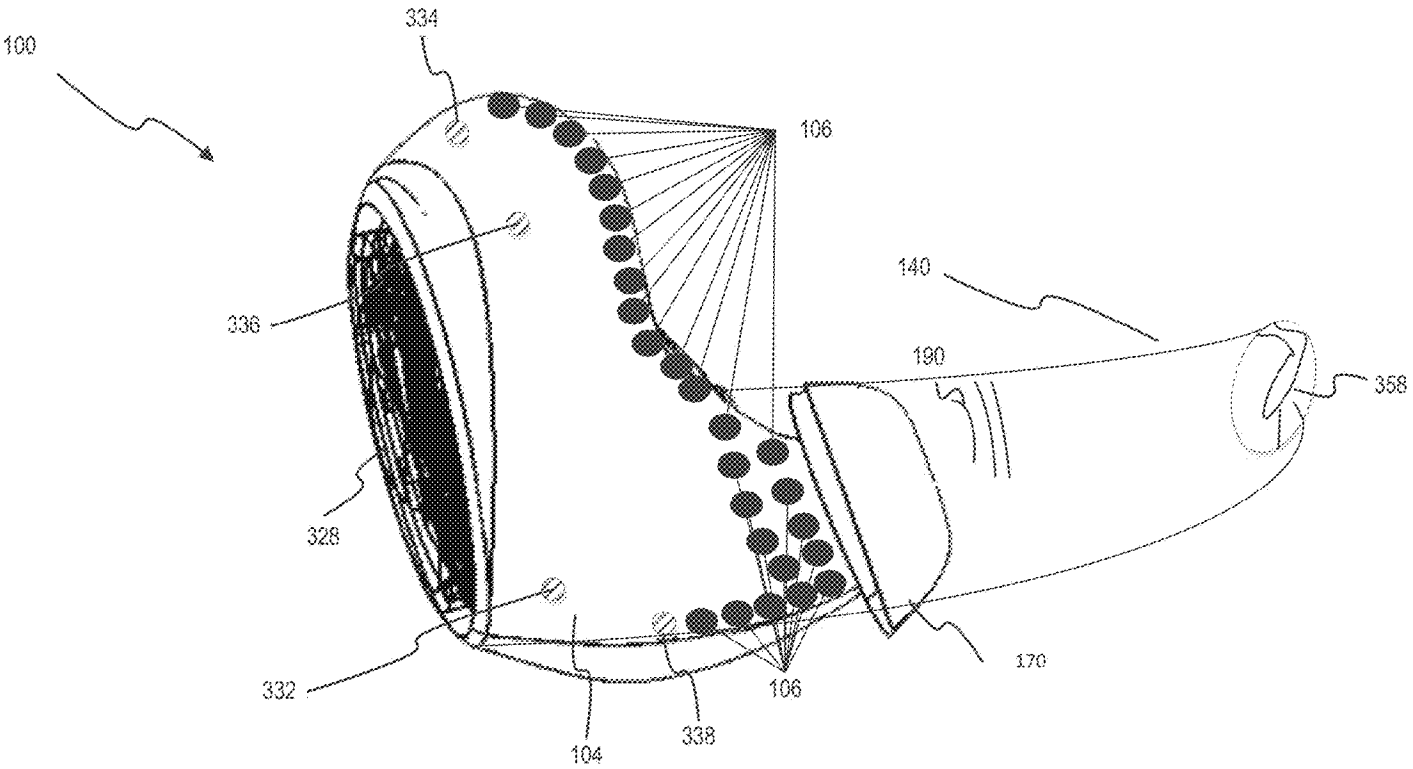
FIG. 5 is a pictorial representation of a wireless earpiece inserted in an ear of a user in accordance with an illustrative embodiment.

FIG. 5 illustrates a side view of the earpiece 100 and its relationship to a user's ear. The earpiece 100 may be configured to minimize the amount of external sound reaching the user's ear canal 140 and/or to facilitate the transmission of audio sound 190 from the speaker 170 to a user's tympanic membrane 358. The earpiece 100 may also have a plurality of contacts 106 positioned throughout the outside of the earpiece 100. The contacts 106 may be of any size or shape capable of receiving a signal and may be positioned anywhere along the housing 104 conducive to receiving a signal. A gesture control interface 328 is shown on the exterior of the earpiece 100. The gesture control interface 328 may provide for gesture control by the user or a third party such as by tapping or swiping across the gesture control interface 328, tapping or swiping across another portion of the earpiece 100, providing a gesture not involving the touching of the gesture control interface 328 or another part of the earpiece 100 or through the use of an instrument configured to interact with the gesture control interface 328. A MEMS gyroscope 332, an electronic magnetometer 334, an electronic accelerometer 336 and a bone conduction microphone 338 are also shown on the exterior of the housing 104. The MEMS gyroscope 332 may be configured to sense rotational movement of the user's head and communicate the data to processor 310, wherein the data may be used in providing force feedback. The electronic magnetometer 334 may be configured to sense a direction the user is facing and communicate the data to the processor 310, which, like the MEMS gyroscope 332, may be used in providing force feedback. The electronic accelerometer 336 may be configured to sense the force of the user's head when receiving force feedback, which may be used by the processor 310 to make the user's experience better as related to head movement. The bone conduction microphone 338 may be configured to receive body sounds from the user, which may be used by the processor 310 in filtering out unwanted sounds or noise. The speaker 170 is also shown and may communicate the audio sound 190 in any manner conducive to facilitating the audio sound 190 to the user's tympanic membrane 358.

The contact surface 102 may also protect the delicate internal components (FIG. 2) of the wireless earpiece 100. For example, the contact surface 102 may protect the wireless earpiece 100 from cerumen 143 (FIG. 5). As previously noted, cerumen is a highly viscous product of the sebaceous glands mixed with less-viscous components of the apocrine sweat glands. In many cases, around half of the components of cerumen on a percentage basis is composed of keratin, 10-20% of saturated as well as unsaturated long-chain fatty acids, alcohols, squalene, and cholesterol. In one form, cerumen is also known as earwax. The contact surface 102 may repel cerumen from accumulating and interfering with the fit of the wireless earpiece 100, playback of audio 190 and sensor readings performed by the wireless earpiece 100. The contact surface 102 may also determine the fit to guide and channel the sound generated by one or more speakers 170 for more effective reception of the audio content while protecting the wireless earpiece 100 from the hazards of internal and external materials and biomaterials.

FIGS. 1 & 5 illustrate the wireless earpiece 100 inserted in an ear of an individual or user. The wireless earpiece 100 fits at least partially into an external auditory canal 140 of the user. A tympanic membrane 358 is shown at the end of the external auditory canal 140.

In one embodiment, the wireless earpiece 100 may completely block the external auditory canal 140 physically or partially block the external auditory canal 140, yet environmental sound may still be produced. Even if the wireless earpiece 100 does not completely block the external auditory canal 140, cerumen 143 may collect to effectively block portions of the external auditory canal 140. For example, the wireless earpiece 100 may not be able to communicate sound waves 190 effectively past the cerumen 143. The fit of the wireless earpiece 100 within the external auditory canal 140 as determined by the contact surface 102 including the contacts 106 and sensors 332, 334, 336 & 338 may be important for adjusting audio 190 and sounds emitted by the wireless earpiece 100. For example, the speaker 170 of the wireless earpiece 100 may adjust the volume, direction, and frequencies utilized by the wireless earpiece 100. Thus, the ability to reproduce ambient or environmental sound captured from outside of the wireless earpiece 100 and to reproduce it within the wireless earpiece 100 may be advantageous regardless of whether the device itself blocks or does not block the external auditory canal 140 and regardless of whether the combination of the wireless earpiece 100 and cerumen 143 impaction blocks the external auditory canal 140. It is to be further understood different individuals have external auditory canals of varying sizes and shapes and so the same device which completely blocks the external auditory canal 140 of one user may not necessarily block the external auditory canal of another user.

The contact surface 102 may effectively determine the fit of the wireless earpiece 100 to exact specifications (e.g., 0.1 mm, microns, etc.) within the ear of the user. In another embodiment, the wireless earpiece 100 may also include radar, LIDAR or any number of external scanners for determining the external shape of the user's ear. The contacts 106 may be embedded or integrated within all or portions of the contact surface 102.

As previously noted, the contact surface 102 may be formed from one or more layers of materials which may also form the contacts 106. The contact surface 102 may repel the cerumen 143 to protect the contacts 106 and the internal components of the wireless earpiece 100 may be shorted, clogged, blocked or otherwise adversely affected by the cerumen 143. The contact surface 102 may be coated with silicon or other external layers make the wireless earpiece 100 fit well and be comfortable to the user. The external layer of the contact surface 102 may be supported by the internal layers, mesh or housing 104 of the wireless earpiece 100. The contact surface 102 may also represent a separate component integrated with or secured to the housing 104 of the wireless earpiece 100.

In one embodiment, the speaker 170 may be mounted to internal components and the housing 104 of the wireless earpiece 100 utilizing an actuator or motor 212 (FIG. 2) processor 310 (FIG. 2) may dynamically adjust the x, y, z orientation of the speaker 170. As a result, audio 190 may be more effectively delivered to the tympanic membrane 358 of the user to process. More focused audio may allow the wireless earpiece 100 to more efficiently direct audio 190 (e.g., directly or utilizing reflections), avoid cerumen 143 (or other obstacles) or adapt the amplitude or frequencies to best communicate with the user. As a result, the battery life of the wireless earpiece 100 may be extended and the hearing of the user may be protected from excessive charging and recharging.

Figure 2:
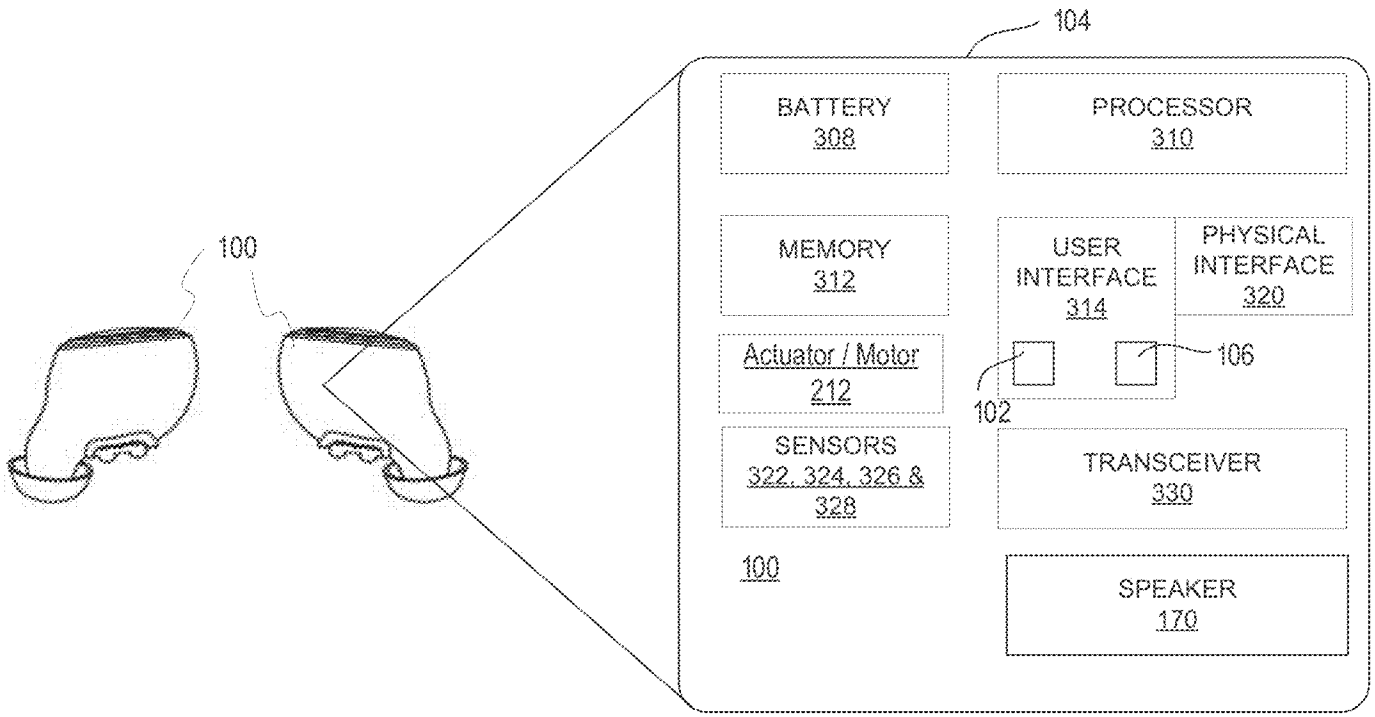
FIG. 2 is a block diagram of wireless earpieces in accordance with an illustrative embodiment.

FIG. 2 is a block diagram of wireless earpieces providing forced feedback in accordance with an embodiment of the present invention. As shown, the wireless earpieces 100 may be physically or wirelessly linked to each other and one or more electronic devices, such as cellular phones, wireless or virtual reality headsets, augmented reality glasses, smart watches, electronic glass, or so forth. User input and commands may be received from either of the wireless earpieces 100 (or other externally connected devices) as discussed above with reference to speaker 170 and gesture control interface 328. As previously noted, the wireless earpiece 100 or wireless earpieces 100 may be referred to or described herein as a pair (wireless earpieces) or singularly (wireless earpiece). The description may also refer to components and functionality of each of the wireless earpieces 100 collectively or individually.

The wireless earpieces 100 can provide additional biometric and user data, which may be further utilized by any number of computing, entertainment, or communications devices. In some embodiments, the wireless earpieces 100 may act as a logging tool for receiving information, data or measurements made by sensors 332, 334, 336 and/or 338 of the wireless earpieces 100. For example, the wireless earpieces 100 may display pulse, blood oxygenation, location, orientation, distance traveled, calories burned, and so forth as measured by the wireless earpieces 100. The wireless earpieces 100 may have any number of electrical configurations, shapes, and colors and may include various circuitry, connections, and other components.

In one embodiment, the wireless earpieces 100 may include a housing 104, a battery 308, a processor 310, a memory 312, a user interface 314, a contact surface 102, contacts 106, a physical interface 328, sensors 322,324, 326 & 328, and a transceiver 330. The housing 104 is a lightweight and rigid structure for supporting the components of the wireless earpieces 100. In one embodiment, the housing 104 is formed from one or more layers or structures of plastic, polymers, metals, graphene, composites or other materials or combinations of materials suitable for personal use by a user. The battery 308 is a power storage device configured to power the wireless earpieces 100. In other embodiments, the battery 308 may represent a fuel cell, thermal electric generator, piezo electric charger, solar charger, ultra-capacitor or other existing or developing power storage technologies.

The processor 310 is the logic controls for the operation and functionality of the wireless earpieces 100. The processor 310 may include circuitry, chips, and other digital logic. The processor 310 may also include programs, scripts and instructions, which may be implemented to operate the processor 310. The processor 310 may represent hardware, software, firmware or any combination thereof. In one embodiment, the processor 310 may include one or more processors. The processor 310 may also represent an application specific integrated circuit (ASIC), system-on-a-chip (SOC) or field programmable gate array (FPGA). The processor 310 may utilize information from the sensors 322, 324, 326 and/or 328 to determine the biometric information, data and readings of the user. The processor 310 may utilize this information and other criteria to inform the user of the associated biometrics (e.g., audibly, through an application of a connected device, tactilely, etc.). Similarly, the processor 310 may process inputs from the contact surface 102 or the contacts 106 to determine the exact fit of the wireless earpieces 100 within the ears of the user. The processor 310 may determine how sounds are communicated based on the user's ear biometrics and structure. Information, such as shape, size, reflectance, impedance, attenuation, perceived volume, perceived frequency response, perceived performance and other factors may be utilized. The user may utilize any number of dials, sliders, icons or other physical or soft-buttons to adjust the performance of the wireless earpieces 100.

In one embodiment, the processor 310 may utilize an iterative process of adjusting volume and frequencies until user approved settings are reached. For example, the user may nod her head when the amplitude is at a desired level and then say stop to when the frequency levels (e.g., high, mid-range, low, etc.) of sample audio have reached desired levels. These settings may be saved for subsequent usage when the user is wearing the wireless earpieces 100. The user may provide feedback, commands or instructions through the user interface 314 (e.g., voice (microphone 338), tactile, motion, gesture control 328, or other input). In another embodiment, the processor 310 may communicate with an external wireless device (e.g., smart phone, computing system 400 (FIG. 4)) executing an application which receives feedback from the user for adjusting the performance of the wireless earpieces 100 in response to the fit data and information. In one embodiment, the application may recommend how the wireless earpieces 100 may be adjusted within the ears of the user for better performance. The application may also allow the user to adjust the speaker performance and orientation (e.g., executing a program for tuning performance based on questions asked of the user and responses given back via user interface 314).

The processor 310 may also process user input to determine commands implemented by the wireless earpieces 100 or sent to the wireless earpieces 304 through the transceiver 330. The user input may be determined by the sensors 322, 324, 326 and/or 328 to determine specific actions to be taken. In one embodiment, the processor 310 may implement a macro allowing the user to associate user input as sensed by the sensors 322, 324, 326 and/or 328 with commands. Similarly, the processor 310 may utilize measurements from the contacts 106 to adjust the various systems of the wireless earpieces 100, such as the volume, speaker orientation, frequency utilization, and so forth.

In one embodiment, the frequency profile or frequency response associated with the user's ears and the fit of the wireless earpieces 100 may be utilized by the processor 310 to adjust the performance of one or more speakers 170. For example, the contact surface 102, the contacts 106 and other sensors 322, 324, 326 and/or 328 of the wireless earpieces 100 may be utilized to determine the frequency profile or frequency response associated with the user's ears and the fit of the wireless earpieces 100. In one embodiment, the one or more speakers 170 may be oriented or positioned to adjust to the fit of the wireless earpieces 100 within the ears of the user. For example, the speakers 170 may be moved or actuated by motor 212 to best focus audio and sound content toward the inner ear and audio processing organs of the user. In another embodiment, the processor 310 may control the volume of audio played through the wireless earpieces 100 as well as the frequency profile or frequency responses (e.g. low frequencies or bass, mid-range, high frequency, etc.) utilized for each user. In one embodiment, the processor 310 may associate user profiles or settings with specific users. For example, speaker positioning and orientation, amplitude levels, frequency responses for audible signals and so forth may be saved.

In one embodiment, the processor 310 is circuitry or logic enabled to control execution of a set of instructions. The processor 310 may be one or more microprocessors, digital signal processors, application-specific integrated circuits (ASIC), central processing units or other devices suitable for controlling an electronic device including one or more hardware and software elements, executing software, instructions, programs, and applications, converting and processing signals and information and performing other related tasks. The processor may be a single chip or integrated with other computing or communications components.

The memory 312 is a hardware component, device, or recording media configured to store data for subsequent retrieval or access at a later time. The memory 312 may be static or dynamic memory. The memory 312 may include a hard disk, random access memory, cache, removable media drive, mass storage, or configuration suitable as storage for data, instructions and information. In one embodiment, the memory 312 and the processor 310 may be integrated. The memory 312 may use any type of volatile or non-volatile storage techniques and mediums. The memory 312 may store information related to the status of a user, wireless earpieces 100 and other peripherals, such as a wireless device, smart case for the wireless earpieces 100, smart watch and so forth. In one embodiment, the memory 312 may display instructions or programs for controlling the user interface 314 including one or more LEDs or other light emitting components, speakers 170, tactile generators (e.g., vibrator) and so forth. The memory 312 may also store the user input information associated with each command. The memory 312 may also store default, historical or user specified information regarding settings, configuration or performance of the wireless earpieces 100 (and components thereof) based on the user contact with the contact surface 102, contacts 106 and/or gesture control interface 328.

The memory 312 may store settings and profiles associated with users, speaker settings (e.g., position, orientation, amplitude, frequency responses, etc.) and other information and data may be utilized to operate the wireless earpieces 100. The wireless earpieces 100 may also utilize biometric information to identify the user so settings and profiles may be associated with the user. In one embodiment, the memory 312 may include a database of applicable information and settings. In one embodiment, applicable fit information received from the contact surface 102 and the contacts 106 may be looked up from the memory 312 to automatically implement associated settings and profiles.

The transceiver 330 is a component comprising both a transmitter and receiver which may be combined and share common circuitry on a single housing. The transceiver 330 may communicate utilizing Bluetooth, near-field magnetic induction (NFMI), Wi-Fi, ZigBee, Ant+, near field communications, wireless USB, infrared, mobile body area networks, ultra-wideband communications, cellular (e.g., 3G, 4G, 5G, PCS, GSM, etc.) or other suitable radio frequency standards, networks, protocols or communications. The transceiver 330 may also be a hybrid transceiver supporting a number of different communications, such as NFMI communications between the wireless earpieces 100 and the Bluetooth communications with a cell phone. For example, the transceiver 330 may communicate with a wireless device or other systems utilizing wired interfaces (e.g., wires, traces, etc.), NFC or Bluetooth communications. Further, transceiver 330 can communicate with computing system 400 utilizing the communications protocols listed in detail above.

The components of the wireless earpieces 100 may be electrically connected utilizing any number of wires, contact points, leads, busses, optical interfaces, wireless interfaces or so forth. In one embodiment, the housing 104 may include any of the electrical, structural and other functional and aesthetic components of the wireless ear-pieces 100. For example, the wireless earpiece 100 may be fabricated with built in processors, chips, memories, batteries, interconnects and other components integrated with the housing 104. For example, semiconductor manufacturing processes may be utilized to create the wireless earpiece 100 as an integrated and more secure unit. The utilized structure and materials may enhance the functionality, security, shock resistance, waterproof properties and so forth of the wireless earpieces 100 for utilization in any number of environments. In addition, the wireless earpieces 100 may include any number of computing and communications components, devices or elements which may include busses, mother-boards, circuits, chips, sensors, ports, interfaces, cards, converters, adapters, connections, transceivers, displays, antennas and other similar components. The additional computing and communications components may also be integrated with, attached to or part of the housing 104.

The physical interface 320 is hardware interface of the wireless earpieces 100 for connecting and communicating with the wireless devices or other electrical components. The physical interface 320 may include any number of pins, arms, ports, or connectors for electrically interfacing with the contacts or other interface components of external devices or other charging or synchronization devices. For example, the physical interface 320 may be a micro USB port. In another embodiment, the physical interface 320 may include a wireless inductor for charging the wireless earpieces 100 without a physical connection to a charging device. In one embodiment, the wireless earpieces 100 may be temporarily connected to each other by a removable tether. The tether may include an additional battery, operating switch or interface, communications wire or bus, interfaces or other components. The tether may be attached to the user's body or clothing (e.g., utilizing a clip, binder, adhesive, straps, etc.) to ensure if the wireless earpieces 100 fall from the ears of the user, the wireless earpieces 100 are not lost.

The user interface 314 is a hardware interface for receiving commands, instructions or input through the touch (haptics) (e.g., gesture control interface 328) of the user, voice commands (e.g., through microphone 338) or predefined motions. The user interface 314 may be utilized to control the other functions of the wireless earpieces 100. The user interface 314 may include the LED array, one or more touch sensitive buttons, such as gesture control interface 328, or portions, a miniature screen or display or other input/output components. The user interface 314 may be controlled by the user or based on commands received from an external device or a linked wireless device.

In one embodiment, the user may provide feedback by tapping the gesture control interface 328 once, twice, three times or any number of times. Similarly, a swiping motion may be utilized across or in front of the gesture control interface 328 to implement a predefined action. Swiping motions in any number of directions may be associated with specific activities, such as play music, pause, fast forward, rewind, activate a digital assistant (e.g., Siri, Cortana, smart assistant, etc.), end a phone call, make a phone call and so forth. The swiping motions may also be utilized to control actions and functionality of the wireless earpieces 100 or other external devices (e.g., smart television, camera array, smart watch, etc.). The user may also provide user input by moving her head in a particular direction or motion or based on the user's position or location. For example, the user may utilize voice commands, head gestures or touch commands to change the content being presented audibly. The user interface 314 may include a camera or other sensors for sensing motions, gestures, or symbols provided as feedback or instructions.

Although shown as part of the user interface 314, the contact surface 102 and the contacts 106 may also be integrated with other components or subsystems of the wireless earpieces 100, such as the sensors 322, 324, 326 and/or 328. As previously described, the contacts 106 may detect physical contact or interaction of the contact surface 102 with the user. In another embodiment, the contacts 106 may detect the proximity of the user's skin or tissues to the contacts 106 to determine the entirety of the fit of the wireless earpieces 100. The contacts 106 may be utilized to determine the shape of the ear of the user.

In one embodiment, the user interface 314 may be integrated with the speakers 170. The speakers 170 may be connected to one or more actuators or motors 212. The speakers 170 may be moved or focused based on the fit of the contact surface 102 within the ears of the user. In another embodiment, the contacts 106 may utilize a map of the ear of the user to adjust the amplitude, direction, and frequencies utilized by the wireless earpieces 100. The user interface 314 may customize the various factors of the wireless earpieces 100 to adjust to the specified user. In one embodiment, the contact surface 102, the contacts 106 or the other systems may include vibration components (e.g., eccentric rotating mass vibration motor, linear resonant actuator, electromechanical vibrator, etc.). The contacts 106 may also include optical sensors for determining the proximity of the user's skin to each of the contacts. The fit may be determined based on measurements (e.g., distance) from a number of contacts 106 to create a fit map for the wireless earpieces 100.

In another embodiment, the contacts 106 may be configured to provide user feedback. For example, the contacts 106 may be utilized to send tiny electrical pulses into the ear of the user. For example, a current may be communicated between different portions of the contact surface 102. For example, current expressed inferior to the wireless earpieces 100 may indicate a text message has been received, current expressed superior to the wireless earpieces 100 may indicate the user's heart rate has exceeded a specified threshold, and a current expressed proximate the ear canal 140 may indicate a call is incoming from a connected wireless device.

In another embodiment, the contacts 106 may be micro air emitters which similarly provide feedback or communications to the user. The micro air emitters may utilize actuators, arms, or miniaturized pumps to generate tiny puffs of air/gas provide feedback to the user. In yet another embodiment, the contacts 106 may be utilized to analyze fluid or tissue analysis from the user. The samples may be utilized to determine biometrics (e.g., glucose levels, adrenaline, thyroid levels, hormone levels, etc.).

The sensors 322, 324, 326 and/or 328 may include pulse oximeters, accelerometers 334, gyroscopes 332, magnetometers 334, thermometers, pressure sensors, inertial sensors, photo detectors, miniature cameras and other similar instruments for detecting location, orientation, motion and so forth. The sensors 322, 324, 326 and/or 328 may also be utilized to gather optical images, data, and measurements and determine an acoustic noise level, electronic noise in the environment, ambient conditions, and so forth. The sensors 322, 324, 326 and/or 328 may provide measurements or data may be utilized to filter or select images or audio content. Motion or sound may be utilized, however, any number of triggers may be utilized to send commands to externally connected devices.

Figure 3:
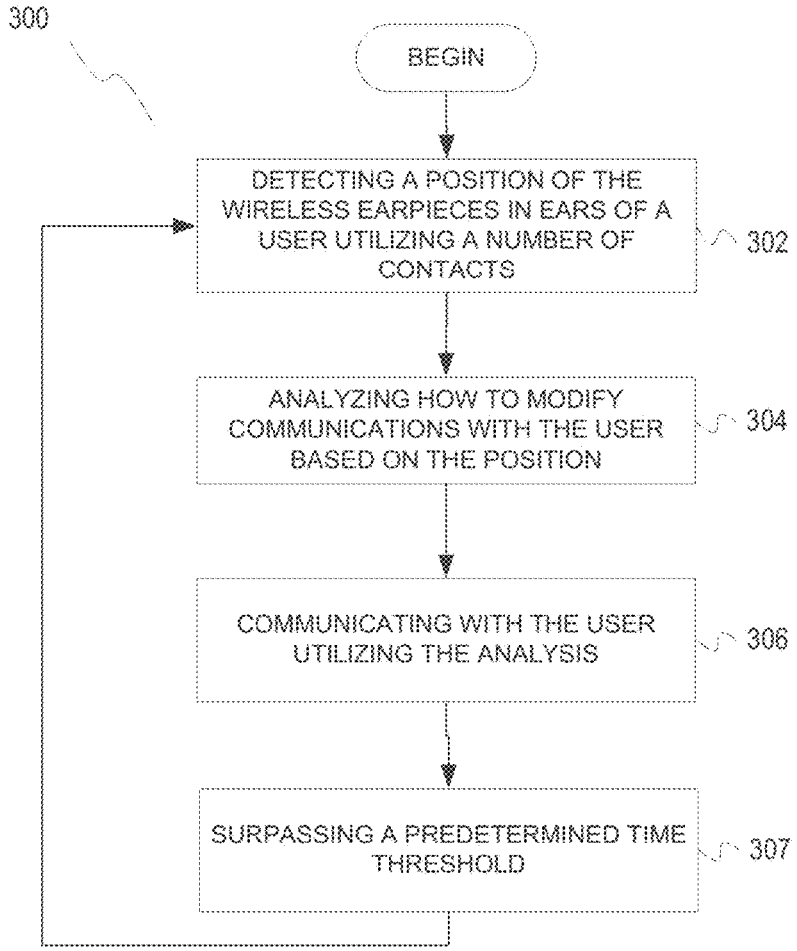
FIG. 3 is a flowchart of a process for providing force feedback in accordance with an illustrative embodiment.

FIG. 3 is a flowchart of a process for providing force feedback in accordance with an illustrative embodiment. In one embodiment, the process of FIG. 3 may be implemented by one or more wireless earpieces 100, such as the wireless earpieces 100 of FIGS. 1, 2 & 5. The wireless earpieces may perform the process of FIG. 3 as a pair or independently. In one embodiment, each of the wireless earpieces may independently measure and adapt to the fit of the left wireless earpiece in the left ear and the right wireless earpiece in the right ear.

The process of FIG. 3 may begin by detecting a position of the wireless earpieces 100 in ears of a user utilizing a number of contacts 106 (step 302). The position of the wireless earpieces 100 may include the orientation, position, distance between the contacts (or contact surface) and the body of the user and other relevant information. The position information and data may define the "fit" of the wireless earpieces 100 within each of the ears of the user. As previously disclosed, the contacts 106 may utilize touch or capacitance, optical or imaging signals (e.g., transmitted and reflected, infrared, light detection and ranging-lidar, etc.), temperature, miniaturized radar or so forth. In one embodiment, the contacts 106 may be flush with the contact surface 102 of the wireless earpieces 100. In another embodiment, the contacts 106 may protrude slightly from the contact surface 102 to more easily facilitate and detect contact between the wireless earpieces 100 and the user. The size and fit of the wireless earpieces 100 may vary based on the size and shape of the user's ear (e.g., tragus, anti-tragus, concha, external acoustic meatus or ear canal, etc.).

A program 300 for implementing the improved audio experience could be implemented by processor 310 as software stored on memory 312 in accordance with one embodiment. In one embodiment, at step 302 the wireless earpieces 100 may enhance communications to a user. The position of the wireless earpieces 100 in the ears of a user can be detected using any one of several tools listed above including but not limited to sensors 332, 334, 336, 338 and contacts 106. Further, contacts 106 can be used to determine what contacts are touching the users ear. Based upon what contacts are touching the user's ear, processor 310 can make a determination as to the orientation of wireless earpiece 100 and based upon this data instruct the user to move or rotate the wireless earpiece 100 through speaker 170 and/or manipulate speaker 170 with motor 212. In one embodiment, contacts 106 can receive a current from the processor 310 in order to ascertain the impedances from a voltage drop associated with each contact 106 in order to determine which contacts 106 are touching the user's ear. Contacts 106 having lower impedances are determined to be in contact with the user's ear while contacts 106 having higher impedances can be determined to not be touching the user's ear. Based upon the number and location of contacts 106 touching the user's ear, processor 310 can determine a best fit or ask the user to move the wireless earpiece 100 until a best fit is found (e.g., all of contacts 106 are touching the user's ear or a large majority of contacts 106 are touching the user's ear).

Next, the wireless earpieces 100 analyze how to modify communications with the user based on the position (step 304) of wireless earpieces 100. During step 304, the wireless earpieces 100 may analyze data from the number of contacts 106 to determine the fit (e.g., position and orientation) of the wireless earpieces 100 in the ears of the user. For example, a processing unit 310 of the wireless earpieces may analyze the fit data and information. In another example, the processing may be offloaded to a wireless device in communication with the wireless earpieces 100. Analysis may indicate the position of the wireless earpieces 100 including the position and orientation of the speaker 170. The analysis may also indicate whether the various sensors 322, 324, 326 and/or 328 of the wireless earpieces 100 are able to make accurate measurements of the user's biometric information. In one embodiment, the wireless earpieces may determine a fit profile associated with the user. Based on user settings or permissions, the wireless earpieces 100 may automatically communicate the fit profile so future generations or versions of wireless earpieces 100 may be modified to better fit users of different body types and ear sizes and shapes.

Next, the wireless earpieces 100 communicate with the user utilizing the analysis (step 306). In one embodiment, the wireless earpieces 100 may adjust the speaker to compensate for the fit of the wireless earpieces 100 in the ears of the user. For example, the amplitude, frequencies, and orientation of the speaker 170 may be adjusted as needed utilizing one or more actuators, motors 212, or other positioners. The adjustments to volume may be performed in real-time to adjust for the movement of the wireless earpieces 100 within the ear (e.g., during running, swimming, biking, or other activities where the wireless earpieces 100 may shift). For example, the volume and frequency profiles utilized by the wireless earpieces 100 may be adjusted in real-time. The size, shape, reflective characteristics, absorption rates, and other characteristics are utilized to determine a proper volume and frequency performance of the speaker 170 of the wireless earpieces 100.

In another embodiment, the contacts 106 may provide direct communications or feedback to the user. For example, the contacts 106 may communicate an electrical or wireless signal perceptible to the user through one or more of the contacts 106 (e.g., small current, electrical pulse, audio signal, infrared signals, etc.). The contacts 106 may also be configured to vibrate or move in and out providing feedback or communications to the user. The communications may correspond to functionality of the wireless earpieces 100 including providing biometric data, location warnings, lost signal warnings, incoming communications alerts (e.g., text, phone call, electronic messages/mail, in-app messages, etc.), application functionality or communications, and so forth.

In one embodiment, the wireless earpieces 100 may communicate information or instructions for enhancing the fit (e.g., position and orientation) of the wireless earpieces 100 within the ears of the user, such as "Please rotate the earpiece clockwise", "Please push the earpiece into place", or "Please secure the earpiece for effective sensor readings." In addition, any number of other specific instructions may be utilized.

In one embodiment, the sensors 322, 324, 326 and/or 328 may be calibrated based on the analysis of step 304 (e.g., fit information). For example, sensitivity, power, bias levels, or other factors may be adjusted based on the fit.

The contact surface 102 and/or contacts 106 may be generated in any number of ways such as chemical vapor deposition, epitaxial growth, nano-3D printing, or the numerous other methods being developed or currently utilized. In one embodiment, the contact surface 102 or contacts 106 may be generated on a substrate or other framework which may make up one or more portions of the wireless earpieces.

In one embodiment, after a predetermined time period is surpassed (step 307), processor 310 would begin again detecting a position of the wireless earpieces 100 in the ears of a user utilizing any means such as contacts 106 and/or sensors 322, 324, 326 and 328 (step 302). The predetermined time threshold could be most any time period from continuous to several seconds to several minutes, to hours or even daily depending on how the processor 310 is modifying the position and/or sound of the wireless earpiece 100. For example, if processor 310 is asking the user to move the wireless earpiece 100 in, around and/or out of ear canal 140 to ensure an modified auditory fit, then it would be intrusive to have the predetermined time limit be continuous or even within seconds or minutes. This would be because the user would be constantly moving and or adjusting the wireless earpieces 100 and this would be annoying and intrusive. Therefore, in an modified setting, the lower the predetermined time threshold, then the more likely the processor 310 would make the auditory sound modification by utilizing motor 212 to move speaker 170 and/or modulate the volume, tone, pitch or any other variable to modify the user's listening experience.

Figure 4:
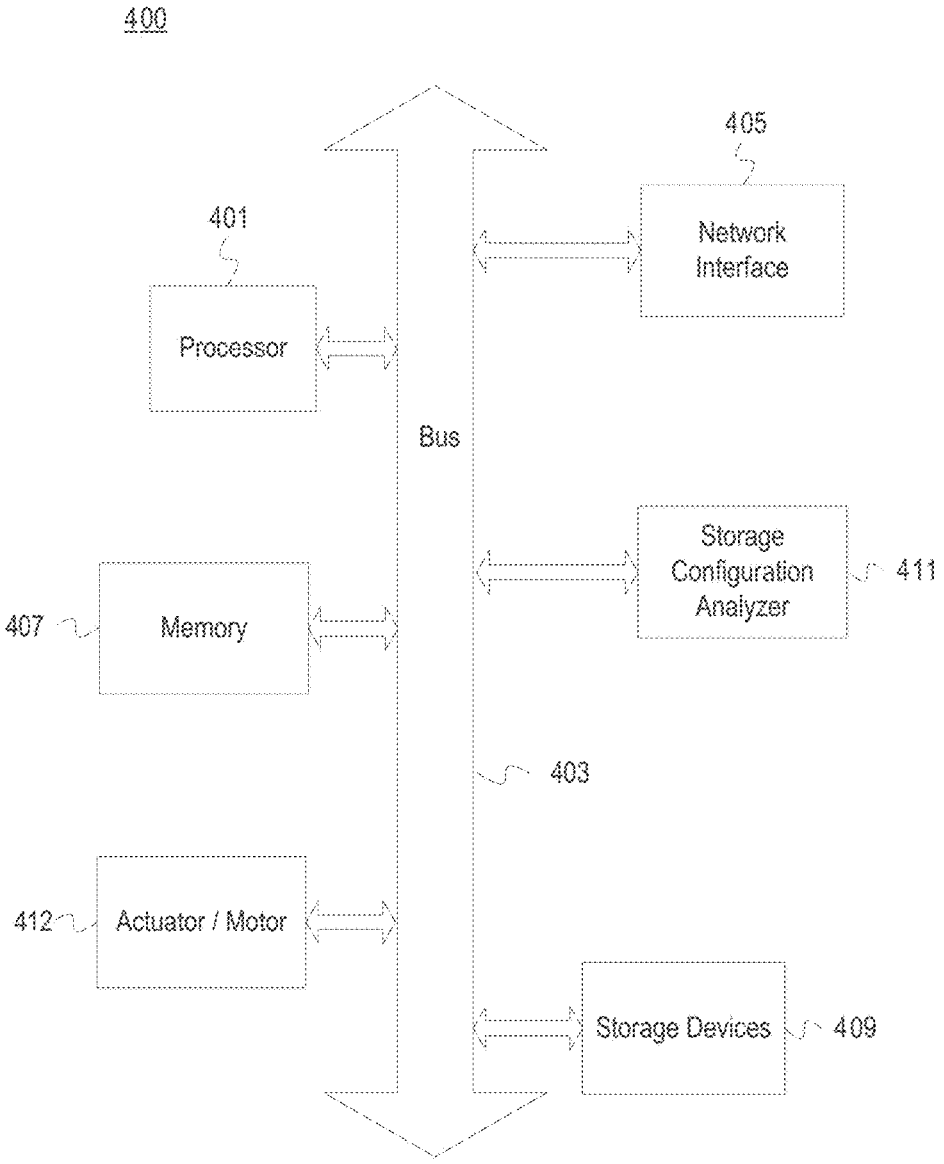
FIG. 4 illustrates a system for supporting force feedback in accordance with an illustrative embodiment.

FIG. 4 depicts a computing system 400 in accordance with an illustrative embodiment. For example, the computing system 400 may represent an electronic computing or communications device, such as an augmented or virtual reality system. The virtual reality system may communicate with wireless earpieces 100, a virtual reality headset, augmented reality glasses, sensors, or other electronics, devices, systems, equipment, or components. The computing device 400 may be utilized to receive user settings, instructions or feedback for controlling the power management features of the wireless earpieces 100 together and separately. The computing system 400 includes a processor unit 401 (possibly including multiple processors, multiple cores, multiple nodes, and/or implementing multi-threading, etc.). The computing system includes memory 407. The memory 407 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computing system also includes a bus 403 (e.g., PCI, ISA, PCI-Express, HyperTransport®, InfiniBand®, NuBus, etc.), a network interface 405 (e.g., an ATM interface, an Ethernet interface, a Housing Relay interface, SONET interface, wireless interface, etc.), and a storage device(s) 409 (e.g., optical storage, magnetic storage, etc.). The system memory 407 embodies functionality to implement embodiments described above. The system memory 407 may include one or more functionalities, which recognize information and data from a contact surface 102 or contacts 106 to modify communications (e.g., alerts, messages, etc.), adjust sensors 322, 324, 326 and/or 328, provide feedback or so forth. The system memory 407 may also store information, settings, or preferences for the processor unit 401 to utilize information and data received directly or indirectly from the wireless earpieces 100. Code may be implemented in any of the other devices of the computing system 400. Any one of these functionalities may be partially (or entirely) implemented in hardware and/or on the processing unit 401. For example, the functionality may be implemented with an application specific integrated circuit, in logic implemented in the processing unit 401, in a co-processor on a peripheral device or card, field programmable gate array and so forth. Further, realizations may include fewer or additional components not illustrated in FIG. 4 (e.g., video cards, audio cards, additional network interfaces, peripheral devices, etc.). The processor unit 401, the storage device(s) 409, and the network interface 405 are coupled to the bus 403. Although illustrated as being coupled to the bus 403, the memory 407 may be coupled to the processor unit 401. It is fully contemplated computing system 400 could be utilized to execute the program 300 (FIG. 3) remotely of wireless earpieces 100. Computing system 400 could be onboard a mobile phone, watch, eyeglasses and/or any other wearable electronic device without departing from the spirit of an embodiment of the present invention.

The illustrative embodiments are not to be limited to the particular embodiments described herein. In particular, the illustrative embodiments contemplate numerous variations in the type of ways in which embodiments may be applied. The foregoing description has been presented for purposes of illustration and description. It is not intended to be an exhaustive list or limit any of the disclosure to the precise forms disclosed. It is contemplated other alternatives or exemplary aspects are considered included in the disclosure. The description is merely examples of embodiments, processes or methods of the invention. It is understood any other modifications, substitutions, and/or additions may be made, which are within the intended spirit and scope of the disclosure. For the foregoing, it can be seen the disclosure accomplishes at least all of the intended objectives.

The previous detailed description is of a small number of embodiments for implementing the invention and is not intended to be limiting in scope. The following claims set forth a number of the embodiments of the invention disclosed with greater particularity.

What is claimed is:

1. A wireless earpiece, comprising:

a frame for fitting in an ear of a user;

a processor integrated with the frame for controlling functionality of the wireless earpiece;

a plurality of contacts operatively connected to the processor for determining a fit of the wireless earpiece within the ear of the user and determining a structure of the ear; and at least one speaker operatively connected to the processor and mounted to the frame via an actuator for communicating audio;

wherein the processor processes input from the plurality of contacts for determining the fit of the wireless earpiece within the ear of the user; and wherein the processor analyzes how to maximize communication of the audio with the user based on the fit of the wireless earpiece and the structure of the ear of the user relative to an orientation of the at least one speaker, and adjusts the actuator to communicate the audio via the at least one speaker with the user utilizing the analysis wherein the at least one speaker communicates the audio.

2. The wireless earpiece of claim 1, wherein the plurality of contacts include optical sensors for determining an external shape of the ear of the user.

3. The wireless earpiece of claim 1, wherein the processor alerts the user of improper positioning of the wireless earpieces within the ear of the user.

4. The wireless earpiece of claim 1, wherein amplitudes and frequencies of the at least one speaker of the wireless earpiece are adjusted in response to the fit of the wireless earpiece.

5. The wireless earpiece of claim 4, wherein the adjusting of the amplitudes and the frequencies is performed iteratively by the processor.

* * * * *